US009298169B2

(12) United States Patent
Van De Wouw et al.

(10) Patent No.: US 9,298,169 B2
(45) Date of Patent: Mar. 29, 2016

(54) WAKE-UP APPLIANCE WITH SNOOZE FUNCTION

(75) Inventors: Inge Van De Wouw, Antwerp (BE); Robert Godlieb, Drachten (NL); Vanja Hommes, Assen (NL); Willem Henderikus Veldhuis, Veendam (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 123 days.

(21) Appl. No.: 14/110,725

(22) PCT Filed: Apr. 5, 2012

(86) PCT No.: PCT/IB2012/051679

§ 371 (c)(1),
(2), (4) Date: Oct. 17, 2013

(87) PCT Pub. No.: WO2012/140549

PCT Pub. Date: Oct. 18, 2012

(65) Prior Publication Data

US 2014/0036642 A1 Feb. 6, 2014

(30) Foreign Application Priority Data

Apr. 14, 2011 (EP) ..... 11162369

(51) Int. Cl.
*G04G 11/00* (2006.01)
*G04G 13/02* (2006.01)

(52) U.S. Cl.
CPC ..... *G04G 13/023* (2013.01); *G04G 11/00* (2013.01); *G04G 13/02* (2013.01)

(58) Field of Classification Search
CPC ..... G04C 19/00; G04C 19/02; G04G 11/00; G04G 13/023
USPC ..... 368/72–74
See application file for complete search history.

(56) References Cited

U.S. PATENT DOCUMENTS

| | | | | |
|---|---|---|---|---|
| 5,079,682 | A * | 1/1992 | Roberts | 362/276 |
| 6,236,622 | B1 * | 5/2001 | Blackman | 368/10 |
| 7,280,439 | B1 * | 10/2007 | Shaddox | 368/73 |
| 7,722,212 | B2 * | 5/2010 | Searfoss | 362/231 |
| 2003/0095476 | A1 * | 5/2003 | Mollicone et al. | 368/250 |
| 2005/0012622 | A1 * | 1/2005 | Sutton | 340/573.1 |

(Continued)

FOREIGN PATENT DOCUMENTS

| | | | |
|---|---|---|---|
| EP | 1959320 | A1 | 11/2006 |
| GB | 2422448 | A | 7/2006 |

(Continued)

OTHER PUBLICATIONS

"Philips WHF3485 Wake Up Light" Philips Britelite 6 Light Therapy Product, Internet Advertisement, 2010.

*Primary Examiner* — Amy Cohen Johnson
*Assistant Examiner* — Jason Collins

(57) ABSTRACT

A wake-up appliance (100; 200; 300) comprises: an alarm device (20) generating an alarm signal; a control device (10) controlling the alarm device; at least one controllable light-generating device (1000; 2000; 3000) controlled by the control device. When the control device finds that an actual time becomes equal to a predetermined alarm time, it activates the alarm device. When the control device receives a user input signal at a snooze input, it stops the alarm signal and increases the intensity of at least a portion of the light generated in a blue range of the light spectrum.

13 Claims, 7 Drawing Sheets

(56) References Cited

U.S. PATENT DOCUMENTS

| | | | | |
|---|---|---|---|---|
| 2006/0293608 | A1* | 12/2006 | Rothman et al. | 600/545 |
| 2008/0103561 | A1* | 5/2008 | Moscovici | 607/88 |
| 2008/0119912 | A1* | 5/2008 | Hayes | 607/88 |
| 2010/0076250 | A1* | 3/2010 | Van Wouderberg et al. | 600/27 |
| 2010/0090612 | A1* | 4/2010 | Spartano | 315/287 |
| 2011/0058456 | A1* | 3/2011 | Van De Sluis et al. | 368/256 |
| 2011/0141856 | A1* | 6/2011 | Cho et al. | 368/11 |
| 2013/0163394 | A1* | 6/2013 | Loree, IV | 368/256 |

FOREIGN PATENT DOCUMENTS

| | | | | | |
|---|---|---|---|---|---|
| GB | 2453359 | A | * | 4/2009 | A61M 21/00 |
| GB | 2468277 | A | | 9/2010 | |
| JP | 2008139031 | | | 6/2009 | |
| WO | 2009077941 | A1 | | 6/2009 | |
| WO | 2009090596 | A1 | | 7/2009 | |
| WO | 2010035200 | A1 | | 4/2010 | |

* cited by examiner

WAKE-UP APPLIANCE WITH SNOOZE FUNCTION

CROSS-REFERENCE TO PRIOR APPLICATIONS

This application is the U.S. National Phase application under 35 U.S.C. §371 of International Application No. PCT/2012/051679, filed on Apr. 5, 2012, which claims the benefit of European Patent Application No. 11162369.0, filed on Apr. 14, 2011. These applications are hereby incorporated by reference herein.

FIELD OF THE INVENTION

The present invention relates in general to the field of wake-up appliances, i.e. appliances that give a signal to a sleeping person to wake him/her up and/or to assist him/her to wake up and get out of bed.

BACKGROUND OF THE INVENTION

Usually, but not necessarily, a wake-up appliance also has a display showing time, which explains why such an appliance is typically also referred to as alarm clock.

Conventionally, alarm clocks just give a sound signal, for instance an alarm sound or music (radio). More recently, wake-up appliances have been developed that include a slowly increasing light level, imitating the sunrise; such appliances are also indicated as wake-up lamp. Wake-up lamps typically also include a time display, although this is not essential for the invention.

The present invention applies to either type of wake-up appliance, whether or not in the form of a wake-up lamp. In any case, the present invention relates to a wake-up appliance of the type giving a clear signal, whether visual or audible or tactile, indicating that the user is supposed to get up at that time; such a clear signal will hereinafter be indicated as alarm signal, and typically such a signal will be a sound signal. Such a sound signal may be a buzz or a beep, but the signal may also include music, played by an integrated player for playing music from a storage medium such as for instance CD, DVD, USB, MP3, or played by a radio tuner.

One may also classify wake-up appliances according to whether or not they provide a snooze function. Without a snooze function, the alarm just goes off (for instance an alarm sound, or music) and the user can either decide to switch it off or to allow it to continue. With a snooze function, the appliance typically includes a snooze button or other control device, switching the alarm (sound, music) off temporarily, and after a predetermined time, for instance 9 minutes, the alarm goes off again. This can be repeated multiple times. Between successive alarm moments, the user can quietly doze further.

The present invention relates to a wake-up appliance with snooze function.

SUMMARY OF THE INVENTION

The user can use the snooze function as a pleasant way of slowly getting out of his sleep before the actual time when he should get out of bed, or as a way of delaying the inevitable. But it does not actually make it easier to get out of bed, in the sense that snoozing as such does not assist in increasing the wakefulness of the user. The present invention aims to provide a wake-up appliance with snooze function that does increase the user's wakefulness.

To this end, the wake-up appliance according to the present invention comprises at least one light-generating element that is capable of generating blue light. Each time the user actuates the snooze button, the intensity of the blue light is increased. The invention utilizes the fact that blue light, particularly light within the wavelength range of 430 nm to 490 nm, more particularly light within the wavelength range of 460 nm to 480 nm, appears to have a relatively high alerting effect on the human physiology.

Further advantageous elaborations are mentioned in the dependent claims.

BRIEF DESCRIPTION OF THE DRAWINGS

These and other aspects, features and advantages of the present invention will be further explained by the following description of one or more preferred embodiments with reference to the drawings, in which same reference numerals indicate same or similar parts, and in which.

DETAILED DESCRIPTION OF THE INVENTION

Figure 1:
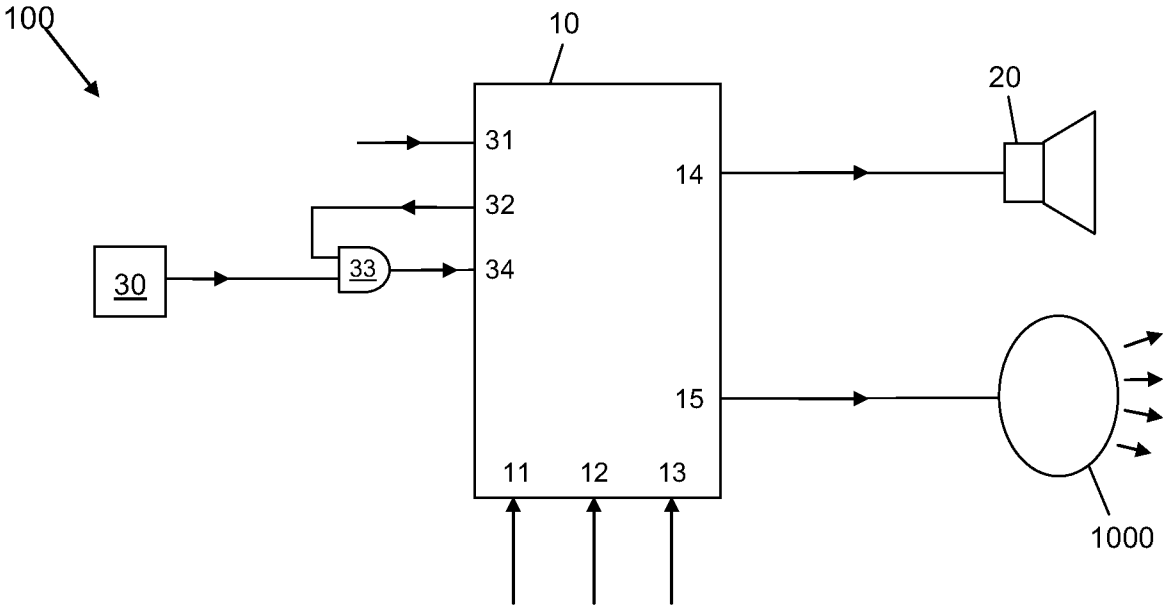
FIG. 1 is a block diagram schematically illustrating the general design of a wake-up appliance according to the present invention.

FIG. 1 is a block diagram schematically illustrating the general design of a wake-up appliance according to the present invention, generally indicated by reference numeral 100. The wake-up appliance 100 comprises an alarm device 20, and a control device 10 having an alarm output 14 for controlling the alarm device 20. The control device has a user snooze input 11 and a user switch-off input 12, for instance implemented as push-buttons or switches. The alarm device 20 is capable of generating an alarm signal, which, in the illustrative example, will be assumed to include a sound signal. It is noted however that alternatives are possible where the alarm device generates a visible signal (for instance TV or video) or a tactile signal.

For audible alarm signals, the alarm device 20 may include a buzzer, a beeper, a radio tuner, a music player, etc., or a combination thereof. The alarm device 20 may thus be a commonly known device, and a further explanation may be omitted here.

Typically, the wake-up appliance 100 also includes a clock display, but this is not shown for the sake of simplicity.

The control device 10 controls the operation of the alarm device 20. The control device 10 has an alarm time setting input 31 for allowing the user to input an alarm time. The appliance 100 includes clock means 30 for providing a signal that represents the actual time, and a comparator 33 for comparing the actual time with the alarm time set by the user, which alarm time is provided by the control device 10 at an output 32. The comparator 33 provides a comparator output signal indicating the comparison result, which is received at an input 34 of the control device 10.

In FIG. 1, the clock 30, comparator 33 and controller 10 are shown as separate units, and the alarm time is input into the controller 10. However, it is also possible that the alarm time is input into the clock 30. It is further possible that the comparator 33 is integrated with the clock 30, or that the comparator 33 is integrated with the controller 10. It is even possible that the functions of clock, comparator and controller are performed by a common integrated device. The only relevant issue is that the control device 10 is provided with means to indicate when the actual time is equal to the alarm time set by the user.

It is assumed that initially the appliance 100 is in a stand-by state; the alarm device 20 is off. When the comparator output signal indicates that the actual time has become equal to the alarm time, the control device 10 makes a transition to an alarm state and activates the alarm device 20. When the user actuates the switch-off input 12, the control device 10, in response, switches off the alarm device 20 and the appliance returns to its stand-by state: the alarm device 20 remains in its off state until the next time that the actual time becomes equal to the alarm time, for instance the next day.

Alternatively, when the control device 10 is in the alarm state, the user may also actuate the snooze input 11. In response, the control device 10 will switch off the alarm device 20 and make a transition to the snooze state. In this snooze state, the control device 10 waits for a predefined amount of time of for instance 9 minutes, and then makes a transition to the alarm state again, activating the alarm device 20 again. The above may be repeated until finally the user actuates the switch-off input 12, causing the control device 10, in response, to switch off the alarm device 20 and return to the stand-by state. Wake-up appliances as described hereinabove are known per se.

It is noted that, as an alternative, it is also possible that the alarm device 20 is not switched off entirely in the snooze state. For instance, it is possible that the output signal is reduced (dimmed), but will be switched to full power at the end of the snooze state; this will be particularly useful if the output signal is music. It is also possible that the alarm device produces a beep signal as well as music, and that, in the snooze state, the beep signal is suppressed but the music continues to play.

The wake-up appliance 100 of the present invention also comprises a light-generating device 1000, capable of generating at least blue light. The control device 10 has a light control output 15 for controlling the light-generating device 1000. The control device 10 further may have a second switch-off input 13, as shown.

As will be explained in more detail, an important aspect of the present invention is the operation of the control device 10 in response to the user's actuation of the snooze input 11: the control device 10 will control the light-generating device 1000 such as to increase the intensity of the blue light output.

In the context of the present invention, the blue range of the light spectrum will be considered to be the wavelength range from 430 to 490 nm. Blue light will be considered to be light having a wavelength within this blue range. Preferred blue light has a wavelength in the range from 460 to 480 nm.

In the context of the present invention, the phrase "at least blue light" is used to indicate that the spectrum of the output light of the light-generating device 1000 has at least one non-zero spectral portion within the blue range. It is not necessary that the spectrum of the output light covers the entire blue range: the output light spectrum may include portions where the intensity is zero within the blue range. Several implementations are possible, as will be explained with reference to FIGS. 2A-2E. In these figures, the horizontal axis represents wavelength, while the vertical axis represents intensity (spectral output power).

Figure 2A:
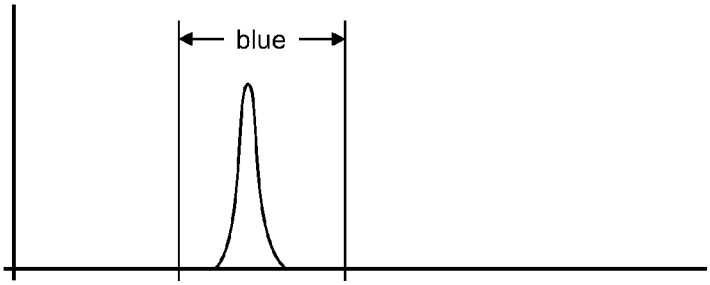
FIGS. 2A-2E are graphs schematically illustrating the spectral output power of possible embodiments of a device according to the present invention.
Figure 2B:
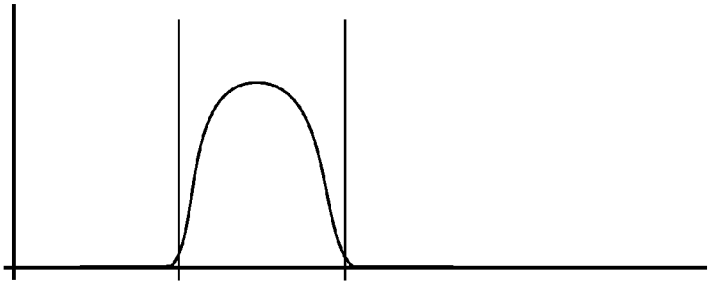
Figure 2C:
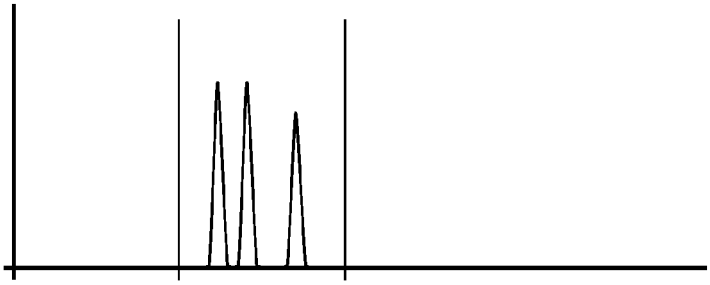

It is possible that the light-generating device 1000 does not have any spectral output outside the blue range, so that 100% of the light output is within the blue range. Such a light-generating device 1000 will be indicated as a "blue only" device, and its overall output light will be indicated as "blue". It is possible that the spectral intensity is non-zero in only one contiguous spectral range, i.e. the spectrum contains only one spectral peak. It is possible that such a peak is narrow with respect to the blue range, as illustrated in FIG. 2A. It is alternatively possible that such a peak has a width comparable to the width of the blue range, as illustrated in FIG. 2B. It is also possible that the spectral intensity is non-zero in two or more spectral sub-ranges, i.e. the spectrum contains multiple spectral peaks, as illustrated in FIG. 2C. Such peaks may or may not be equidistant, and may or may not be of the same height.

Figure 2D:
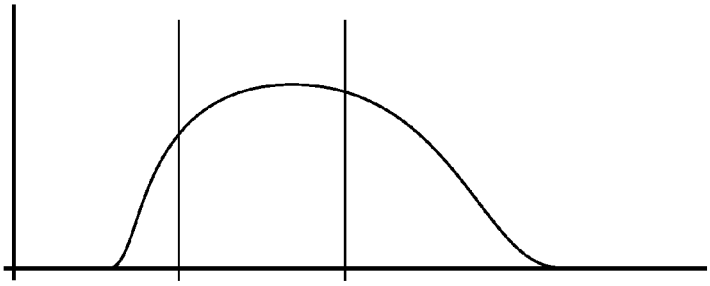
Figure 2E:
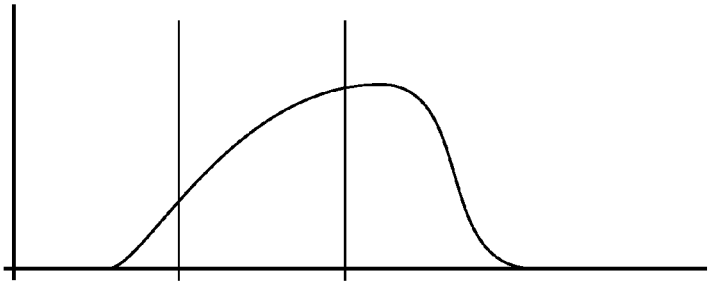

It is possible that the light-generating device 1000 does have a spectral output outside the blue range, so that the integrated spectral intensity of the light-generating device 1000 within the blue range (which will hereinafter also be indicated as blue intensity) is less than 100% of the overall integrated intensity of said device. When the blue output power is higher than 50% of the overall output power, the light-generating device 1000 will be indicated as a "mainly blue" device, and its overall output light will be indicated as "mainly blue". Within the blue range, the spectral output may be as indicated above, while additionally there is spectral output outside the blue range. This spectral output outside the blue range may for instance comprise one or more narrow and/or wide peaks, a continuum, etc. Further, it is possible that the spectral intensity is non-zero in at least one relatively wide contiguous spectral range comprising at least part of the blue range or even comprising the entire blue range, as illustrated in FIG. 2D. It is even possible that the highest intensity value is located at a wavelength outside the blue range, as illustrated in FIG. 2E.

In this context, the phrase "integrated intensity in a wavelength range" is used to mean an integral of intensity over wavelength, according to the following formula:

$$\Phi(\lambda 1;\lambda 2)=\int_{\lambda 1}^{\lambda 2} I(\lambda)\,d\lambda$$

wherein $\lambda$ indicates wavelength, wherein $\lambda 1$ and $\lambda 2$ indicate the borders of the wavelength range, wherein $I(\lambda)$ indicates spectral intensity at wavelength $\lambda$, and wherein $\Phi(\lambda 1;\lambda 2)$ indicates the integrated intensity of the output light in the wavelength range from $\lambda 1$ to $\lambda 2$.

It is noted that the spectral intensity does not need to be constant within the blue range: in the case where a spectrum, or a portion thereof, has a more or less Gaussian profile, it is possible to define a central wavelength where the highest intensity value is reached. Preferably, this central wavelength lies within the blue range. It is also possible to define the width of the light spectrum as the width measured at 50% of the peak height: preferably, this width of the light spectrum lies within the blue range.

Figure 3:
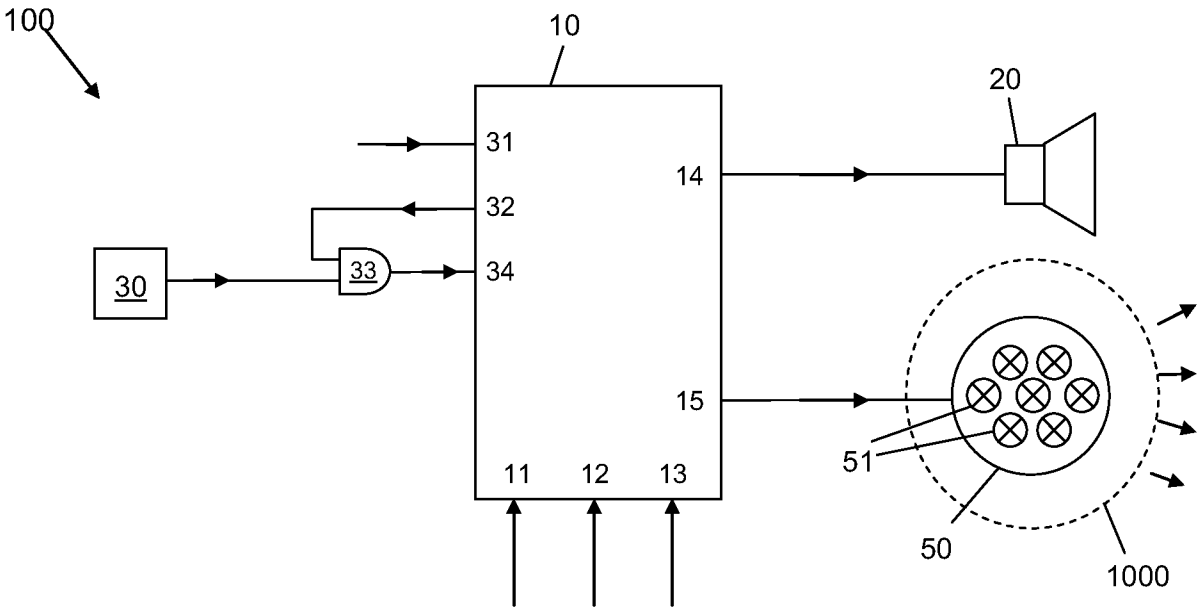
FIG. 3 is a block diagram schematically illustrating a first embodiment of a wake-up appliance according to the present invention.

In a first embodiment configuration, the light-generating device 1000 comprises just one light source 50. Such an embodiment is illustrated schematically in FIG. 3. In the context of the present invention, an entity will be indicated as a separate light source if it can be controlled independently by the control device 10. FIG. 3 shows that the control device 10 has one light source control output 15 for controlling said one light source 50. In this arrangement, the control device 10 can only switch on or off the light source 50 as a whole, or increase or decrease the light output intensity of the light source 50 as a whole, but the spectrum of the output light will remain substantially constant. Nevertheless, the light source 50 itself may comprise one or more light-generating elements 51, which may be mutually identical so that they have the same output spectrum, but even this is not essential. The light source 50 may also comprise just one light-generating element 51.

The type of light-generating element 51 is not essential, but preferably the light-generating element 51 is implemented as an LED. A suitable LED, suitable for being used as light-generating element 51 in light source 50, is referred to as type 599LB7C, which is commercially available from the company Hebei International Trading (Shanghai) Co., Ltd. of Shanghai, China. Alternatively, the light-generating element 51 may be implemented as an OLED, a fluorescent lamp, a discharge lamp, etc.

It is noted that LEDs are typically driven by an electronic circuit indicated as a driver. In FIG. 3, such a driver is not shown separately: it is considered to be included in the control device 10.

The operation is as follows. When the user actuates the snooze input 11 for the first time, the control device 10 will make a transition to the snooze state and switch on the light source 50, or, if the light source 50 was already on, the control device 10 will increase the output power of the light source 50. Later, when the user actuates the snooze input 11 again, the control device 10 will again increase the light output of the light source 50. It is noted that the present invention comes to expression even if the control device 10 increases the light output of the light-generating element 50 in response to only one of the user's snooze input actions, but it is preferred that the control device 10 increases the light output each time the user actuates the user snooze input 11, until, eventually, a maximum light output level is reached. It is further noted that the amount of light increase may differ after different snooze input actions.

When the user actuates the alarm switch-off input 12 and the control device 10 returns to its stand-by state, the control device 10 may also switch off the light-generating device 1000. However, it is also possible that the control device 10 switches off the light-generating device 1000 in response to the user actuating the second switch-off input 13.

The manner in which the blue light output intensity is increased in response to the user actuating the snooze input 11 may be implemented in several ways. It is possible that the blue light output intensity is increased step-wise from the current level to a new level, and then maintained constant until the alarm goes off. It is also possible that the blue light output intensity is increased gradually from the current level to a new level, and then maintained constant until the alarm goes off. It is also possible that the blue light output intensity is increased gradually, continuously, until the alarm goes off. Combinations of the above possibilities are also possible.

It is further noted that the control device 10 may effect the increase in blue light output immediately upon performing the transition to the snooze state, but also later during the snooze state, or both.

Figure 4:
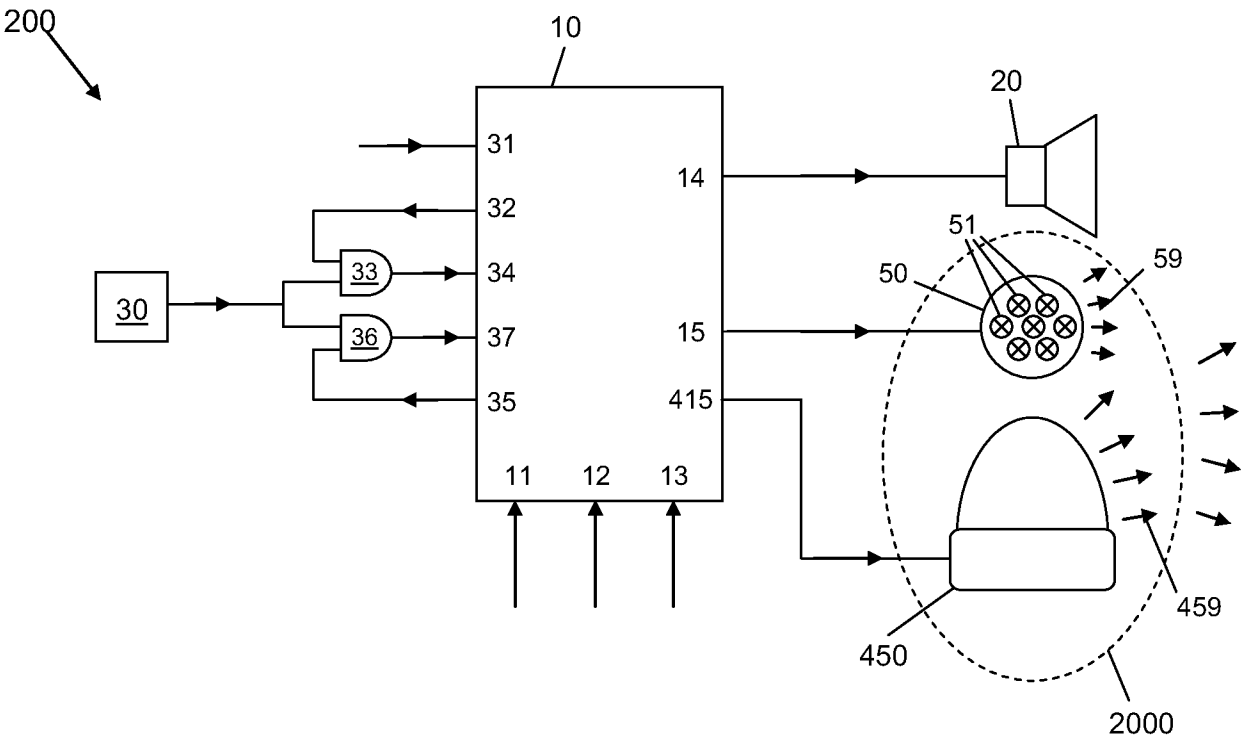
FIG. 4 is a block diagram schematically illustrating a second embodiment of a wake-up appliance according to the present invention.

FIG. 4 is a block diagram schematically illustrating a second embodiment configuration of a wake-up appliance according to the present invention, generally indicated by reference numeral 200. The wake-up appliance 200 again comprises an alarm device 20, a light-generating device now indicated by reference numeral 2000, and a control device 10 for controlling the alarm device 20 and the light-generating device 2000. The control device again has a user snooze input 11, a user switch-off input 12 for switching off the alarm, and a second user switch-off input 13 for switching off the light-generating device 2000. The alarm device 20 may be identical to the alarm device described with reference to FIGS. 1 and 3, and the operation of the control device 10 with respect to the alarm device 20 may also be identical to the operation described with reference to FIGS. 1 and 3, so the description thereof need not be repeated here.

The light-generating device 2000 comprises said one light source 50 described above for the first embodiment. With respect to the light-generating device 1000 of the first embodiment, the light-generating device 2000 additionally comprises at least one additional light source 450. The two light sources 50 and 450 are separate, meaning that they can be controlled by the control device 10 independently: the control device 10 has a first light source control output 15 for controlling the first light source 50 and a second light source control output 415 for controlling the second light source 450. The first light source 50 is identical to the one described hereinabove in the context of the first embodiment, so its description does not need to be repeated.

Like the first light source 50, the second light source 450 may consist of one light-generating element or a plurality of light-generating elements. In a specific embodiment, the second light source 450 is a wake-up lamp. It is noted that, as far as structural design is concerned, it is possible that the two light sources 50 and 450 are physically separate, but it is also possible that they are mounted in a common housing so that, instead of perceiving two spatially separated light sources, a user only perceives the overall output light of the light-generating device 2000, i.e. the mix of output light from the first light source 50 and output light from the second light source 450, as originating from one source. It is even possible that the first light source 50 is mounted within a housing of the second light source 450.

Since wake-up lamps are known per se, a description thereof will be kept brief here. It is just noted that a wake-up lamp may comprise one or more light generating elements, for instance LED(s), fluorescent lamp(s), etc. The control device 10 controls the wake-up light 130 such as to slowly increase its light output from a minimum level to a maximum level, for instance from 0 to 100%. Typically, the control device 10 starts doing so before the alarm device 20 goes off. FIG. 5 A is a graph illustrating the possible timing of a wake-up lamp with a snooze function in general. The user has set the alarm at time tA. The control device 10 switches the alarm device 20 on at time tA, and switches it off again when the user actuates the snooze input 11 at time ts1. After a snooze interval, the control device 10 switches the alarm device 20 on again at time tA2, and switches it off again when the user actuates the snooze input 11 at time ts2. This is repeated at times tA3 and ts3, and may be repeated many times more. Curves 21, 22, 23 indicate the operative state of the alarm device 20. In this illustrative example, the user actuates the first switch-off input 12 at time ts3, so that the control device 10 switches back to the stand-by state, and actuates the second switch-off input 13 slightly later.

Curve 459 indicates the light output of the wake-up lamp 450, and illustrates that the control device 10 has switched on the wake-up lamp 450 at a time tWUL, earlier than the alarm time tA, and that its light output gradually rises from zero. The figure shows a linear relationship between light output and time, but that is not essential. This figure also shows that the light output of the wake-up lamp 450 reaches its maximum around time tA, which is preferred yet not essential. The figure also shows that the wake-up lamp 450 is switched off in response to the user actuating the second switch-off input 13. For detecting when the actual time is equal to the time tWUL for starting the wake-up lamp, the figure shows that the system may include a second comparator 36, receiving a signal indicating actual time from the clock 30, and receiving a signal from the control device 10 indicating time tWUL, which signal is provided by the control device at an output 35, and the output signal from this second comparator 36 is received by the control device 10 at an input 37. The same remarks as made before apply to this second comparator 36: it may for instance be integrated in the control device 10.

Figure 5A:
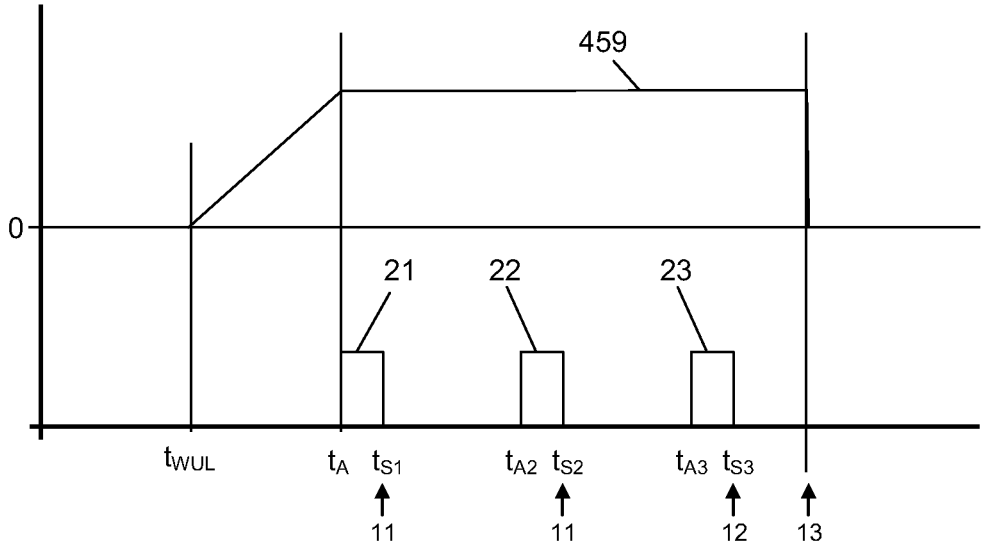
FIG. 5A is a graph illustrating possible alarm—time settings of a wake-up lamp with snooze function.
Figure 5B:
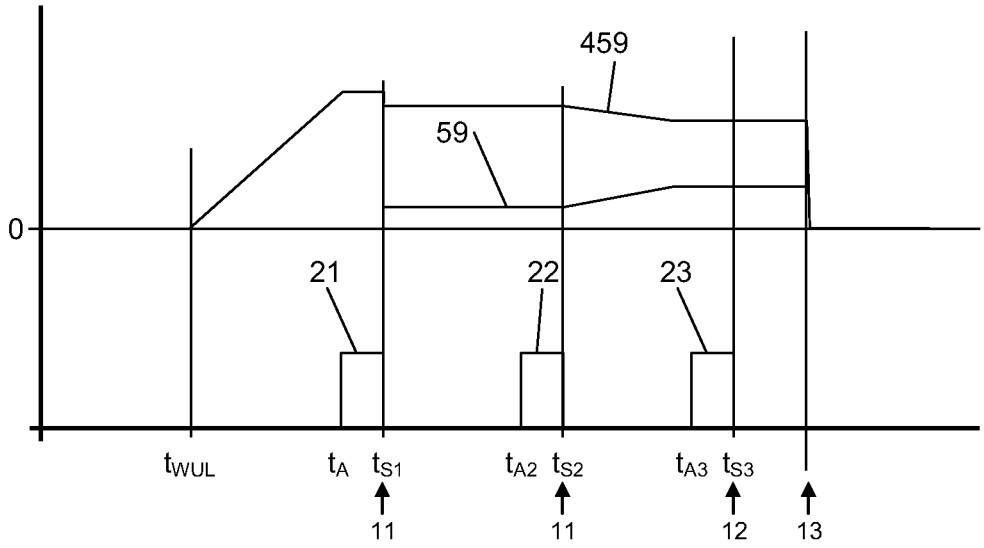
FIG. 5B is a graph comparable to FIG. 5A, illustrating the operation of a wake-up appliance according to the present invention.

FIG. 5A shows the normal operation in the absence of the snooze-response according to the present invention. FIG. 5B is a graph comparable to FIG. 5A, illustrating the operation of the device 200 according to the present invention. Curve 59 indicates the light output of the first light source 50. It can clearly be seen that, in the snooze state, the control device 10 always increases this light output. This can be done for instance stepwise (shown at time ts1) or gradually (shown between time ts2 and ta3). Increases in light output (whether stepwise or gradually) may be of the same size, but that is not essential. The control of the wake-up lamp 450 may be unamended as compared to that of FIG. 5A.

In principle, with respect to the first controllable light source 50, the control is the same as in the first embodiment: in response to the user's snooze actions, i.e. at the beginning of or during the snooze state, the output power of the first light source 50 is increased, resulting in an increase of the amount of blue light generated. The advantageous effect is found in the fact that blue light, especially light within the wavelength range of 430 nm to 490 nm, and particularly light within the wavelength range of 460 nm to 480 nm, appears to have a relatively high alerting effect on the human physiology. By virtue of the addition of the second controllable light source 450, whether this is a wake-up lamp or not, further possibilities are available for the control device 10.

It is to be noted that the light output from the second controllable light source 450 will typically have a colour point different from that of the first controllable light source 50. Thus, when the control device 10 increases the output power of the first light source 50, the light output of the light-generating device 2000 as a whole increases, and the colour point of the output light of the light-generating device 2000 as a whole shifts. The control device 10 may adapt its control of the second controllable light source 450 to compensate for this.

In a first possible embodiment, the control device 10 adapts its control of the second controllable light source 450 to reduce the intensity of the output light of the second controllable light source 450 simultaneously with and to the same extent as any increase in the output power of the first light source 50, so that, in the perception of the user, the overall light output (perceived brightness) of the light-generating device 2000 as a whole remains substantially constant. Such operation is illustrated in FIG. 5B. It is noted that it is also possible that the control device 10 controls the light-generating device 2000 as a whole such that the overall light output brightness follows a predefined function of time (not necessarily remaining constant), with increases in the blue light output being compensated by decreases in the light output of the second controllable light source 450. The overall result will nevertheless be an increase of the amount of blue light.

In a second possible embodiment, if the second controllable light source 450 has a controllable output colour, the control device 10 adapts its control of the second controllable light source 450 to change the colour point of the output light of the second controllable light source 450 simultaneously with any increase of the output power of the first light source 50, in such a way that, in the perception of the user, the colour point of the light-generating device 2000 as a whole remains substantially constant.

Figure 6:
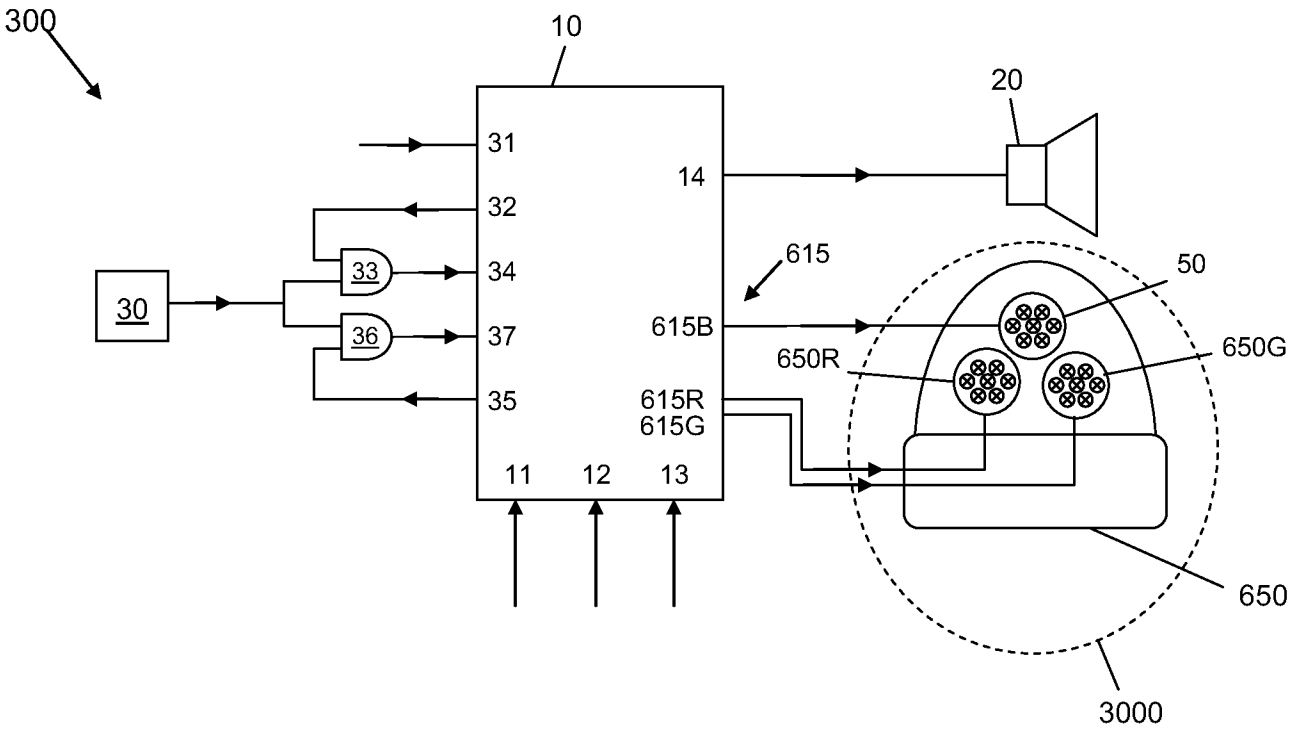
FIG. 6 is a block diagram schematically illustrating a third embodiment of a wake-up appliance according to the present invention.

FIG. 6 is a block diagram schematically illustrating a third embodiment configuration of a wake-up appliance according to the present invention, generally indicated by reference numeral 300. The wake-up appliance 300 again comprises an alarm device 20, a light-generating device now indicated by reference numeral 3000, and a control device 10 for controlling the alarm device 20 and the light-generating device 3000. The control device again has a user snooze input 11, a user switch-off input 12 for switching off the alarm, and a second user switch-off input 13 for switching off the light-generating device 3000. The alarm device 20 may be identical to the alarm device described with reference to FIGS. 1 and 3, and the operation of the control device 10 with respect to the alarm device 20 may also be identical to the operation described with reference to FIGS. 1 and 3, so the description thereof need not be repeated here.

In this embodiment, the light-generating device 3000 is implemented as a wake-up lamp 650 comprising a plurality of light sources 50, 650R, 650G, of mutually different colour, including at least one light source 50 generating blue light, or mainly blue light, or partially blue light. The light source 50 may be identical to the one described hereinabove; the other light sources may for instance be light sources for generating mainly or exclusively red (R) and green (G) light, respectively, but other colours are also possible. Instead of two additional light sources 650R, 650G, the wake-up lamp 650 may have just one, or three or more additional light sources. Suitable light sources may include fluorescent lamps, LEDs, etc. The light-generating device 3000 is of a type having a controllable output colour, which is effected by individually controlling the light output of the individual light sources. In FIG. 6, this is visualized in that a control output 615 for the wake-up lamp 650 is subdivided into three separate control outputs 615B, 615R, 615G, i.e. one control output for said one light source 50, one separate control output 615R for the light source 650R and one separate control output 615G for the light source 650G. By setting a suitable ratio of the respective light intensities, the control device 10 can set the overall colour of the overall output light of the wake-up lamp 3000 to be almost white, or reddish, or yellowish, or blueish, as desired.

Figure 7:
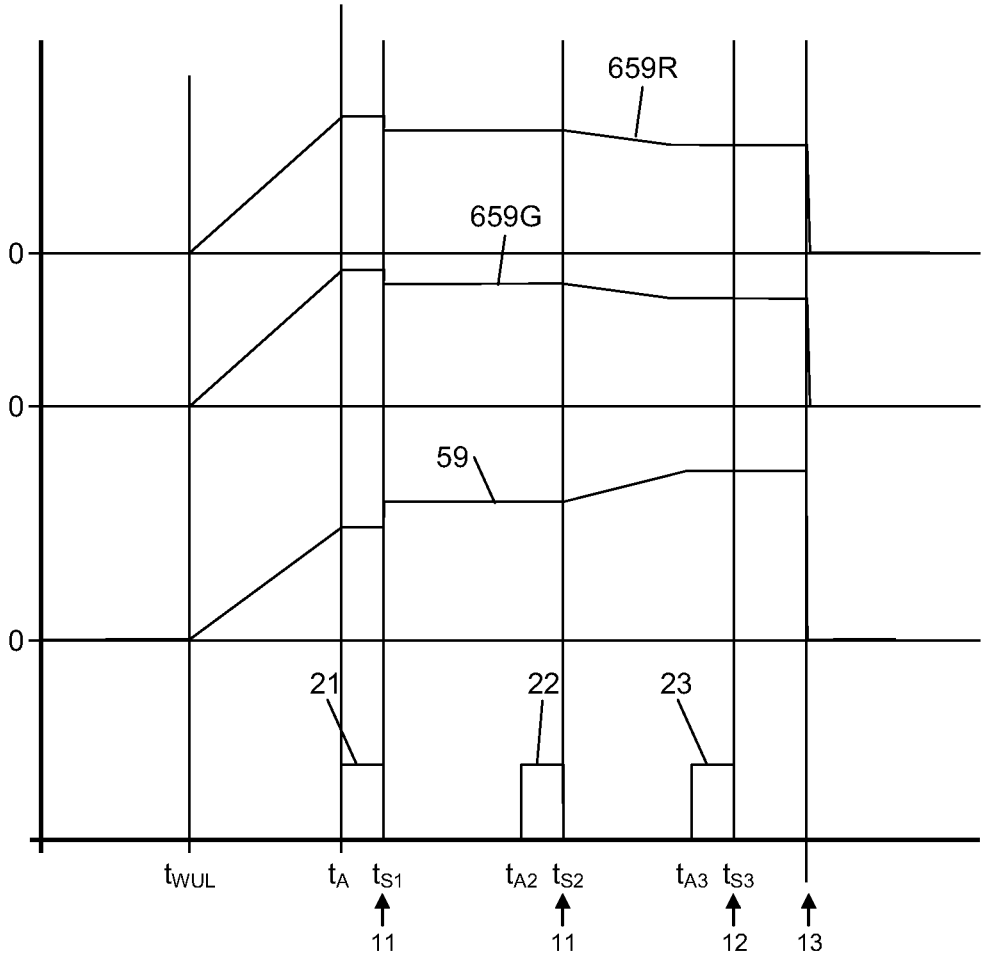
FIG. 7 is a graph comparable to FIG. 5B, illustrating the operation of the third embodiment.

FIG. 7 is a graph comparable to FIG. 5B, illustrating the operation of this embodiment. When operating in accordance with the present invention, the control device 10 will first generate its output signals such as to slowly increase the light output of all light sources 50, 650R, 650G as from time tWUL, in order to obtain the wake-up lamp functionality. After the alarm time tA, in the snooze states, the control device 10 will boost the light output of the blue light source 50 (stepwise, or gradually, or continuously), in the manner described in the above. In the same manner as described for the second embodiment 2000, the control device 10 may keep the light output of the other light sources 650R, 650G of the wake-up lamp 650 constant, or may adapt the control of the other light sources 650R, 650G of the wake-up lamp 650 such as to keep constant the intensity or the colour point of the overall output light of the wake-up lamp 3000.

Thus, the present invention provides a wake-up appliance 100; 200; 300 comprising an alarm device 20 generating an alarm signal, a control device (10) controlling the alarm device, and at least one controllable light-generating device 1000; 2000; 3000 controlled by the control device.

When the control device finds that an actual time becomes equal to a predetermined alarm time, it activates the alarm device. When the control device receives a user input signal at a snooze input, it stops the alarm signal and increases the intensity of at least a portion of the light generated in a blue range of the light spectrum.

While the invention has been illustrated and described in detail in the drawings and foregoing description, it should be clear to a person skilled in the art that such illustration and description are to be considered illustrative or exemplary and not restrictive. The invention is not limited to the disclosed embodiments; rather, several variations and modifications are possible within the protective scope of the invention as defined in the appended claims.

In the above, the invention has been described for a specific embodiment where the relative spectral intensity in the blue region is increased at the moment when the user actuates the snooze button, and otherwise remains constant. More generally, the relative blue intensity may also increase during the snooze intervals. However, it is also possible that, after the user has actuated the snooze button, the control device 10 waits for a predetermined delay time before increasing the blue light output.

It is further noted that in a "normal" wake-up light, when the light output is gradually increased with time, this increase also involves an increase of the absolute intensity in the blue region. In spite of this, the overall perceived colour may remain the same. However, in a "normal" wake-up light, the light output is typically increased only in the time frame before the alarm time tA. In the present invention, the blue light is increased after the alarm time tA, in response to a snooze input signal.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage. Any reference signs in the claims should not be construed as limiting the scope.

In the above, the present invention has been explained with reference to block diagrams, which illustrate functional blocks of the device according to the present invention. It is to be understood that one or more of these functional blocks may be implemented in hardware, where the function of such one or more functional blocks is performed by individual hardware components, but it is also possible that one or more of these functional blocks are implemented in software, so that the function of such one or more functional blocks is performed by one or more program lines of a computer program or a programmable device such as a microprocessor, microcontroller, digital signal processor, etc.

The invention claimed is:

1. Wake-up appliance comprising:

an alarm device for generating an alarm signal;

a control device for controlling the operation of the alarm device, the control device having a snooze input for receiving a user input signal;

at least one controllable light-generating device controlled by the control device, wherein said light-generating device is capable of generating light within at least a blue range of the light spectrum;

wherein the control device is capable of operating in an alarm state and in a snooze state;

wherein the control device is designed to activate, when operating in the alarm state, the alarm device to produce the alarm signal;

wherein the control device is designed to make a transition, in response to receiving a user input signal at its snooze input, to the snooze state and control the alarm device to stop the alarm signal or reduce the signal intensity of the alarm signal, then wait for a predetermined snooze interval, and subsequently make a transition back to the alarm state and re-activate the alarm device; and wherein the control device is designed to control, in response to receiving the user input signal at its snooze input, the light-generating device to increase the light intensity in at least part of said blue range;

wherein said light-generating device comprises at least one first light source capable of generating output light having a spectrum that is non-zero within at least one sub-range within said blue range of the light spectrum;

wherein the control device is designed to increase the light intensity of said at least one first light source in at least part of the blue range of the light spectrum each time the control device receives the user input signal and otherwise remains constant; and wherein said light-generating device further comprises at least one second light source controlled by the control device independently of said at least one first light source.

2. Wake-up appliance according to claim 1, wherein said blue range of the light spectrum lies within a spectral range from 430 to 490 nm.

3. Wake-up appliance according to claim 1, wherein said blue range of the light spectrum lies within a spectral range from 460 to 480 nm.

4. Wake-up appliance according to claim 1, wherein the output light of said at least one first light source has a spectrum that is zero for all wavelengths outside said blue range of the light spectrum.

5. Wake-up appliance according to claim 1, wherein the following formula applies:

$$\Phi(Bl; Bu) \geq 0.5 \cdot \Phi(0; \infty)$$

wherein $$\Phi(Bl; Bu) = \int_{Bl}^{Bu} I(\lambda)\, d\lambda$$

wherein indicates the integrated light intensity of the output light of said at least one first light source generated within said blue range of the light spectrum, with Bl indicating a lower limit wavelength of the blue range, Bu indicating an upper limit wavelength of the blue range, and I(λ ) indicating the spectral intensity at wavelength λ;

and wherein $$\Phi(0;\infty) = \int_0^\infty I(\lambda)\,d\lambda$$

indicates the overall integrated light intensity of the light generated by said at least one first light source.

6. Wake-up appliance according to claim 1, wherein said at least one second light source is implemented as a wake-up lamp, and wherein the control device is designed to control the at least one second light source such that, whenever the light intensity of said at least one first light source is increased in response to receiving the user input signal, the light intensity of said at least one second light source is maintained constant.

7. Wake-up appliance according to claim 1, wherein the control device is designed to control the second light source to reduce the output light intensity of the second light source and simultaneously increase the light intensity of said first light source, such that the perceived overall intensity of all light output from said light-generating device remains constant.

8. Wake-up appliance according to claim 1, wherein the control device is designed to control the at least one second light source to change the color of the output light of the at least one second light source and simultaneously increase the light intensity of said at least one first light source, such that the perceived overall color point of all light output from said light-generating device remains constant.

9. Wake-up appliance according to claim 1, wherein said light-generating device is implemented as a wake-up lamp and comprises said one first light source and one second light source controlled by the control device independently of said first light source.

10. Wake-up appliance according to claim 1, wherein the control device is designed to control the at least one second light source to change the output light intensity of the at least one second light source and simultaneously increase the light intensity of said at least one first light source, such that the perceived overall color point of all light output from said light-generating device remains constant.

11. Wake-up appliance according to claim 1, wherein the control device is designed to increase the light intensity of blue light stepwise and simultaneously make the transition to the snooze state.

12. Wake-up appliance according to claim 1, wherein the control device is designed to always increase the light intensity of blue light in response to each user input signal received at its snooze input.

13. Wake-up appliance according to claim 1, wherein the control device is designed to control the at least one second light source and said at least one first light source in response to receiving the user input signal at the snooze input in such way that the light intensity of said at least one first light source is increased while the increase in the light output of said at least one first light source is compensated by a decrease in the light output of the second controllable light source such that the overall light output brightness follows a predefined function of time.

* * * * *